US008405564B2

(12) United States Patent
Kindt et al.

(10) Patent No.: US 8,405,564 B2
(45) Date of Patent: Mar. 26, 2013

(54) WAVELENGTH-SCALED ULTRA-WIDEBAND ANTENNA ARRAY

(75) Inventors: Rickie W. Kindt, Arlington, VA (US); Mark Kragalott, Woodbridge, VA (US); Mark G Parent, Port Tobacco, MD (US); Gregory C Tavik, Rockville, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 638 days.

(21) Appl. No.: 12/617,167

(22) Filed: Nov. 12, 2009

(65) Prior Publication Data

US 2010/0117917 A1 May 13, 2010

Related U.S. Application Data

(60) Provisional application No. 61/113,936, filed on Nov. 12, 2008.

(51) Int. Cl.
*H01Q 13/00* (2006.01)

(52) U.S. Cl. ..... 343/770

(58) Field of Classification Search ..... 343/770, 343/843, 893

See application file for complete search history.

(56) References Cited

U.S. PATENT DOCUMENTS 6,650,291 B1 * 11/2003 West et al. ..... 342/371
7,034,753 B1 4/2006 Elsallal et al.
7,215,284 B2 * 5/2007 Collinson ..... 343/700 MS

OTHER PUBLICATIONS

B. Cantrell, J. Rao, G. Tavik, M. Dorsey, V. Krichevsky, "Wideband Array Antenna Concept", *IEEE Radar Conference Proceedings*, pp. 680-684 (May 9, 2005).

* cited by examiner

*Primary Examiner* — Robert Karacsony
(74) *Attorney, Agent, or Firm* — Amy L. Ressing; L. George Legg

(57) ABSTRACT

An ultra-wideband antenna array architecture includes a first array of radiating elements, a second array of radiating elements, and a third array of radiating elements, with their respective element widths proportionately ascending in size. In one configuration, the first array radiating element width is half a wavelength at the highest frequency of operation, the second array element width is twice the first width, and the third array element width is twice the second width. The first, second, and third arrays are positioned in a wavelength-scaled lattice wherein the wavelength scaling is based on design operative frequencies and whereby adjacent actively-radiating elements for an operative frequency are aligned so as to produce constructive interference when powered up. Feed means such as a diplexer with a selected-band frequency control then provides power to each array.

22 Claims, 16 Drawing Sheets

WAVELENGTH-SCALED ULTRA-WIDEBAND ANTENNA ARRAY

CROSS-REFERENCE TO RELATED APPLICATIONS

This Application claims the benefit of U.S. Provisional Application 61/113,936 filed on Nov. 12, 2008, and incorporated herein by reference.

FIELD OF THE INVENTION

The present disclosure relates generally to an ultra-wideband antenna array architecture and more particularly to a wavelength-scaled array (WSA) architecture that systematically uses interaligned radiators of different sizes to achieve a single UWB aperture with significantly-reduced element count.

BACKGROUND OF THE INVENTION

Multi-functional antenna array apertures for military and commercial use promise a larger number of applications with better performance at lower overall cost, weight, and installation space. A central component in these systems is the ultra-wideband (UWB) phased antenna array. Traditional UWB arrays are very costly to build due to the high element density required for scanning across a wide range of frequencies. In order to make multi-functional apertures a viable option, there is significant interest in finding a way to reduce the cost of UWB array designs.

UWB arrays are commonly based on the flared-notch (Vivaldi) array element, e.g. as described in M. Kragalott. W. R. Pickles, and M. S. Kluskens, "Design of a 5:1 bandwidth stripline notch array from FDTD analysis," *IEEE Transactions on Antennas and Propagation*, Vol. 48, pp. 1733-1741 (2000). The flared-notch is a popular element because it is relatively easy to manufacture and provides excellent bandwidth and scan performance. In recent years, UWB array research has focused on developing low-cost alternatives including: lower cost element designs, such as is described in W. Croswell, T. Durham, M. Jones, D. H. Schaubert, P. Frederich, and J. G. Maloney, "Wideband Array." *Modern Antenna Handbook*, C. A. Balanis, Wiley (2008); manufacturing technologies, such as described in H. Holter, "Dual-Polarized Broadband Array Antenna With BOR-Elements, Mechanical Design and Measurements," *IEEE Trans. Antennas Propagat*, vol. 55, pp. 305-312 (2007); and assembling techniques, such as described in M. W. Elsallal and D. H. Schaubert, "Electronically scanned arrays of dual-polarized, doubly-mirrored balanced antipodal Vivaldi antennas (DmBAVA) based on modular elements," Conference Proceedings, IEEE Antennas and Propagation Society International Symposium, 9-14 Jul. 2006. These techniques are primarily intended to reduce the cost of UWB systems at the element level, but do not address the issue of excessive numbers of elements in large UWB systems.

Another approach described in B. Cantrell, J. Rao, G. Tavik, M. Dorsey, and V. Krichevsky, "Wideband Array Antenna Concept," 2005 IEEE International Radar Conference Record, pp. 680-684, proposed a UWB array with reduced element count featuring a core of traditional wideband flared-notch elements surrounded by concentric rings of increasingly-larger (reduced bandwidth) elements, each new ring having the same number of radiators as the outer ring of the UWB core. This architecture was designed to achieve relatively-constant electrical aperture size versus frequency with significantly fewer elements than traditional UWB arrays. This concept is similar to thinned narrowband arrays, such as those described in R. Mailoux, *Phased Array Antenna Handbook,* 2nd ed.: Artech House (2005), because it leads to lower element count, but it also differs significantly in that (1) it is for UWB and not narrowband arrays, (2) the outer elements are scaled in size and (3) the aperture is not fully illuminated at all frequencies. The Cantrell concept was not practical for implementation due to the high number of different-size array elements as well as mutual coupling/structural integrity issues associated with element misalignment. It is therefore desirable to provide a UWB array of reduced size, complexity, and cost compared with previous such efforts.

BRIEF SUMMARY OF THE INVENTION

According to the invention, an ultra-wideband antenna array architecture includes a first array of radiating elements, a second array of radiating elements, and a third array of radiating elements, with their respective element widths proportionately ascending in size. In one configuration, the first array radiating element width is half a wavelength at the highest frequency of operation, the second array element width is twice the first width, and the third array element width is twice the second width. The first, second, and third arrays are positioned in a wavelength-scaled lattice wherein the wavelength scaling is based on design operative frequencies and whereby adjacent actively-radiating elements for an operative frequency are aligned so as to produce constructive interference when powered up. Feed means such as a diplexer with a selected-band frequency control then provides power to each array.

The wavelength-scaled array (WSA) architecture systematically uses interaligned radiators of different sizes to achieve a single UWB aperture with significantly-reduced element count. The elements operate coherently in overlapping frequency bands. Overall element count savings is determined by the number of scaled element in the array aperture embodiment. For example, using three levels of scaled elements it is possible to create an 8:1 bandwidth array with 16% of the original element count—i.e., 6.4-times fewer elements than an equivalent conventional periodic array of equivalent aperture size. The new architecture provides a significant reduction in the amount of front-end electronics, and by extension, a similar reduction in overall cost. The VSWR and scan capabilities of the WSA aperture will be similar to the conventional UWB array upon which the WSA is based. Further, the radiation characteristics of the WSA embodiment of the invention compare favorably with conventional UWB arrays—i.e. demonstrating symmetric patterns with typical sidelobe structures, excellent array mismatch efficiency and compatible cross-polarization levels.

DETAILED DESCRIPTION OF THE INVENTION

Figure 1:
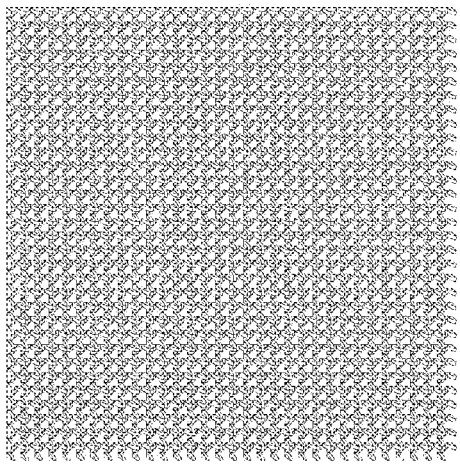
FIG. 1 PRIOR ART
FIG. 1 is a schematic illustration of a prior art 8:1 bandwidth ultra-wideband (UWB) phased array radar for offset-center element pairs on a rectangular lattice, 1024 total elements.

The following description of the invention assumes a UWB phased array with a 12-degree beamwidth and coverage from 6-48 GHz (8:1 bandwidth), although it should be understood and will be made clear that the invention is not limited to just this embodiment. For reference, we describe first the current state of prior art UWB. For operation at the high end of the frequency band (48 GHz), the requisite array element is roughly 3 mm in width (given typical ½ wavelength lattice spacing requirements). Referring now to FIG. 1, to achieve a 12-degree beamwidth at this frequency in a conventional prior art UWB array, an aperture of roughly four wavelengths is required, or equivalently, an 8×8 array of 3 mm elements. To achieve a 12-degree beamwidth three octaves lower in frequency (12 GHz), an aperture of roughly four wavelengths (and equivalently 100 mm diameter) is required. This equates to an array of 32×32 3 mm-wide elements, with 1,024 elements total (in each polarization).

Figure 2:
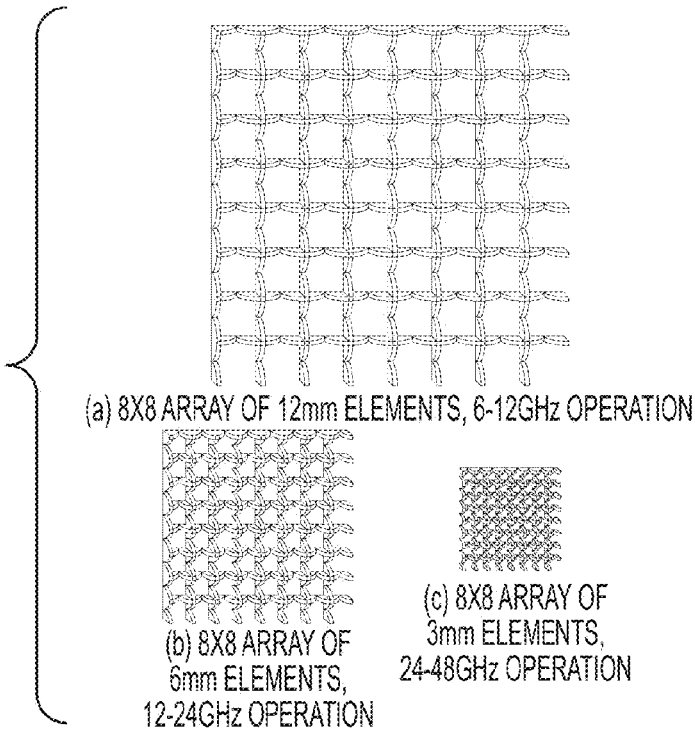
FIG. 2 PRIOR ART
FIG. 2 is a schematic illustration of three separate 2:1 bandwidth prior art arrays, 192 total elements.

Referring now to FIG. 2, another conventional design employs three separate arrays of reduced bandwidth. This consists of an 8×8 array of 3 mm elements (12-degree beamwidth at 48 GHz), an 8×8 array of 6 mm elements (12-degree beamwidth at 24 GHz), and an 8×8 array of 12 mm elements (12-degree beamwidth at 12 GHz). This approach uses a total of 192 elements in each polarization, which is more than 5-times fewer overall elements than that shown in FIG. 1. The main drawbacks are the three separate apertures operate independently over distinct 2:1 bands, and the separate apertures require additional installation space and weight, which is NOT acceptable for certain (E.G. NAVY) applications.

Figure 3:
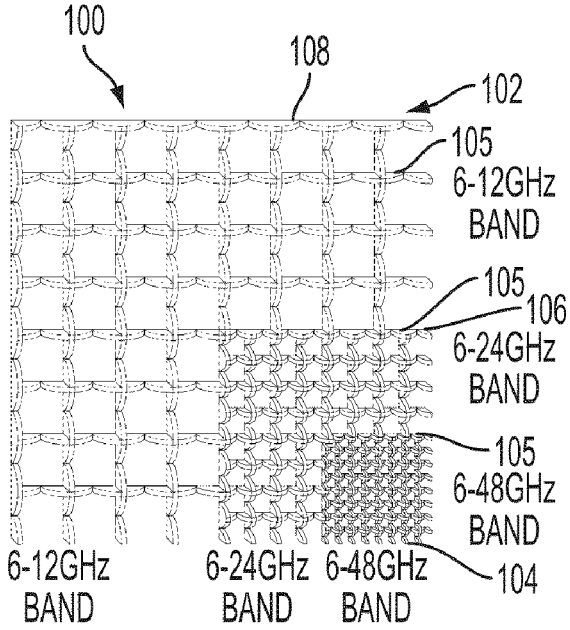
FIG. 3 is a schematic illustration of an 8:1 bandwidth ultra-wideband (UWB) wavelength-scaled array (WSA) of an equivalent WSA architecture for offset-center element pairs on a rectangular lattice (160 total elements, full 6-48 GHz operation) according to the invention.

A more efficient architectural approach is the invention provided here. Referring now to FIG. 3, the WSA of the invention in embodiment 100 comprises a lattice 102 with a first array 104 of radiating elements 105, a second array 106 of radiating elements 105 adjacent the first array 104, and a third array of radiating elements 108 adjacent the second array 106. Each radiating element 105 in the first array 104 has a width less than the width of each radiating element 105 of the second array 106, and likewise each radiating element 105 in the second array 104 has a width less than the width of each radiating element 105 of the third array 108. The first, second, and third arrays are positioned in the wavelength-scaled lattice 102 with their respective radiating element widths selected wherein the wavelength scaling is based on design operative frequencies and whereby adjacent actively-radiating elements for an operative frequency are inter-aligned, i.e. mutually aligned along the lattice points as shown, so as to produce constructive interference when powered up and maintaining wideband operating modes across the integrated aperture of different elements.

The WSA provides a more cost-effective UWB solution than prior art shown in FIG. 1, integrating into a single aperture even fewer overall elements than the three separate, reduced-bandwidth arrays of FIG. 2—only 160 elements in each polarization—, that is, 85% (6.4-times) fewer elements and 20% fewer elements, respectively. The elements of three different sizes (in this case—3 mm, 6 mm, 12 mm) function together coherently to create a continuous aperture with 8:1 bandwidth. It is important to understand that the apertures do not function independently. Rather, from 6-12 GHz, all the elements of the array are active, creating a single, coherently-radiating aperture. From 12-24 GHz, only the 6 mm and 3 mm elements are active, creating a scaled and electrically equivalent aperture as the one operating from 6-12 GHz. From 24-48 GHz, only the 3 mm elements are active, creating a radiating aperture that is scaled and electrically equivalent to the aperture radiating in the 24-48 GHz band, and also the 6-12 GHz band. Effectively, within these three frequency bands, the apertures have the same electrical size.

The invention preferably includes the following design capabilities and parameters. First, an element that provides a full 8:1 bandwidth is employed—which in this embodiment is the 3 mm-wide element, operating from 6-48 GHz. The remaining elements—6 mm and 12 mm—should be able to achieve at least 4:1 bandwidth and 2:1 bandwidth, respectively, overlapping the same low-end frequencies of the 3 mm element. Hence, the WSA architecture should be based on several ultra-wideband array elements and not pieced together with narrowband elements. Next, to achieve uniform radiation patterns, the element excitations should be scaled based on their cell size to create uniform power density across the aperture. Further, the wideband operation of UWB arrays typically depends on tightly-coupled electrical contact between adjacent array elements. Hence, in order for a WSA to maintain wide bandwidth, proper coupling between elements at transition regions should be ensured, which in this case is achieved by aligning every other row of the scaled elements.

The present embodiment follows a 2-to-1 scaling profile—i.e. the element size increases by a factor of two—such that every-other element row/column lines up exactly at the interface between element regions. The element reduction estimates presented here are independent of array size, beamwidth and bandwidth, but they assume three levels of element scaling, following a 2-to-1 scaling profile at each level. Using four levels of element scaling provides even greater savings in the number of elements, but requires a 16:1 bandwidth element, again assuming a 2-to-1 scaling profile at all levels. It is alternatively possible to use other scaling profiles such as 3-to-1—i.e. every third row of elements aligned. In general, this choice can be made to meet aperture/bandwidth needs based on required applications, and may also depend on the type of array element. Similarly, a WSA can be created from just two levels of scaling. This array has the same functionality as the WSA with three levels of 2-to-1 scaling but will likely have a higher element count.

Figure 17:
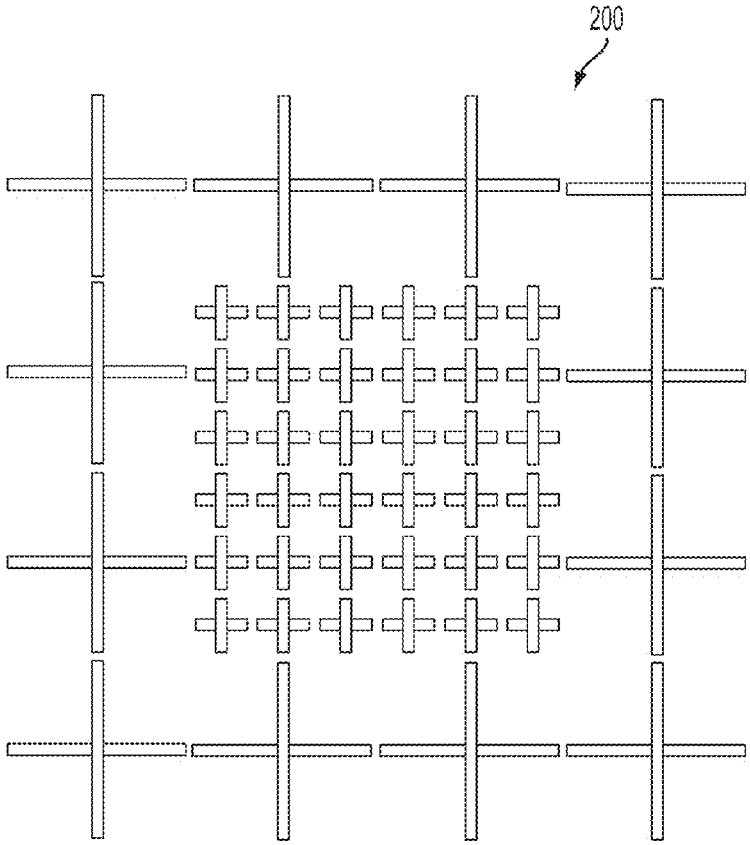
FIG. 17 is an embodiment of the WSA architecture for co-incident phase center element pairs on a rectangular lattice according to the invention.
Figure 18:
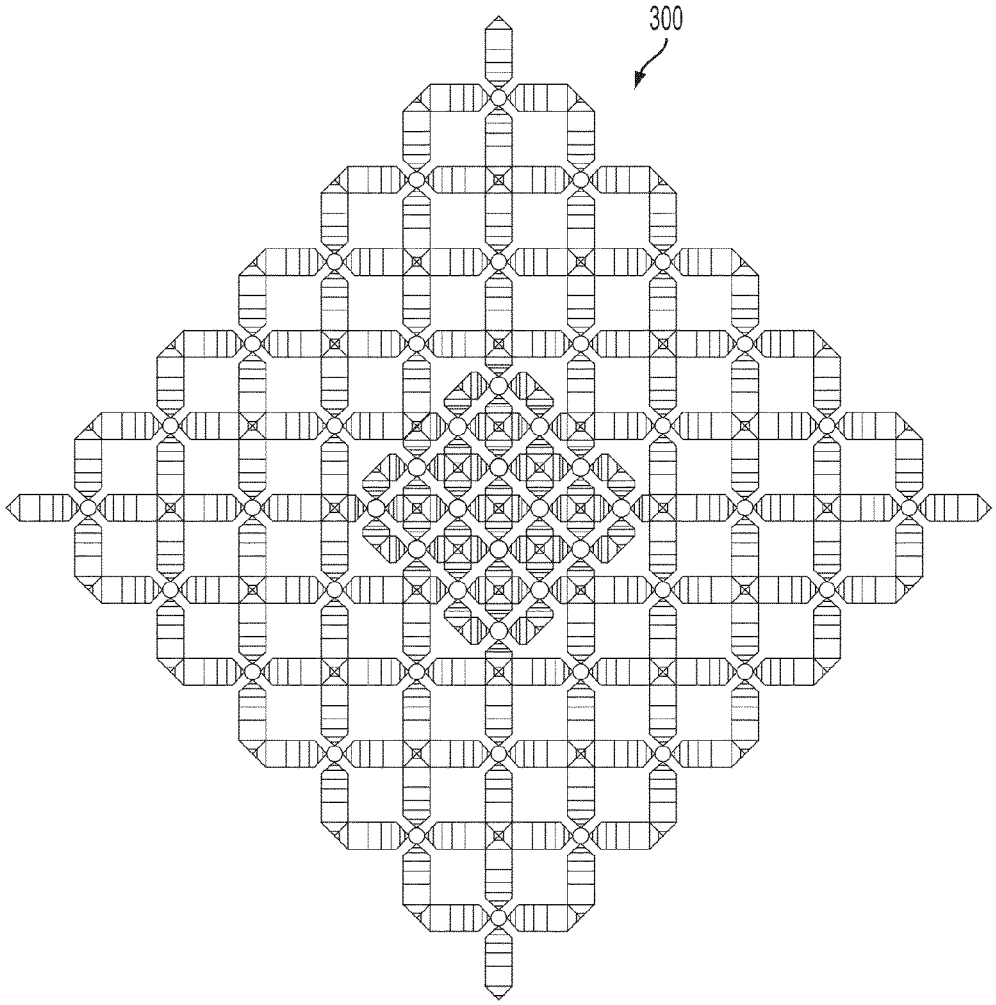
FIG. 18 is an embodiment of the WSA architecture for co-incident phase center element pairs on a triangular/diamond lattice according to the invention.

In the present WSA embodiment, the high-frequency elements are located in the lower right corner of the array rather than symmetrically in the center, as shown in FIG. 3. This design choice is made for two primary reasons. First, the elements are constructed in pairs, and placing the smaller elements in the center region does not allow for proper element pairing, leading to geometric interference. Secondly, this layout reduces the number of transition regions, thereby reducing performance degradation due to any mismatch occurring at the element interfaces. It will be shown that this design choice does not significantly affect cross-polarization levels or pattern symmetry. However, if elements are paired such that they have coincident phase centers, it is then possible to configure the WSA such that the smallest, most-dense elements are in the center region. This is merely a matter of geometric layout, both layouts having the same functionality. FIGS. 17 and 18 illustrate these embodiments 200 and 300 of the invention, where the latter has a diamond or triangular lattice configuration.

Figure 4:
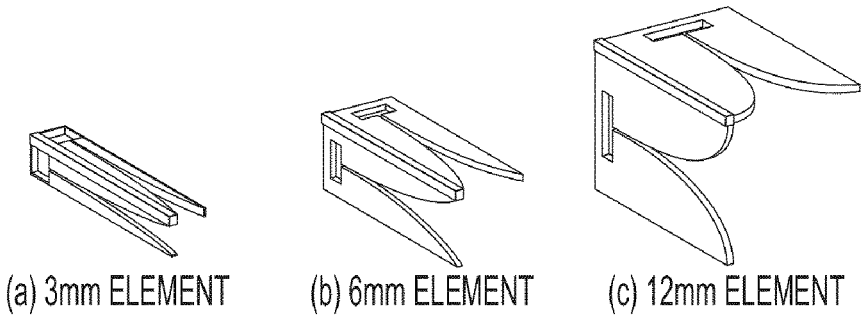
FIG. 4 is a schematic illustration of the three UWB element models used to construct the WSA of FIG. 3 according to the invention.

The WSA is built from three dual-polarized UWB element models, as shown in FIG. 4, scaled using a 2-to-1 profile for a full 8:1 bandwidth array design. Although this design employs flared-notches, it should be understood that the WSA can readily employ other radiator types. As is traditionally the case, the dual-polarized elements are constructed in pairs of horizontal and vertical elements. The WSA has a 3 mm-wide UWB element with 8:1 bandwidth, shown in FIG. 4(*a*). FIGS. 4(*b*) and (*c*) show the elements of the WSA that operate from 6-24 GHz (6 mm wide) and 6-12 Ghz (12 mm wide) respectively. All three elements have the same physical length in the broadside radiation direction to facilitate proper geometric integration into a composite array with roughly the same radiation path length for all elements. To facilitate proper geometric integration, the elements share common (0.76 mm-diameter) post. This design choice allows the thickness of the individual elements to be manipulated for adjusting the impedance match. Additionally, the slot-line cavity dimensions and slot tapers have been adjusted to achieve the desired impedance matching. For modeling purposes, all elements are fed with a 50 Ohm lumped-element port at the base of the slot-line cavity.

Figure 5:
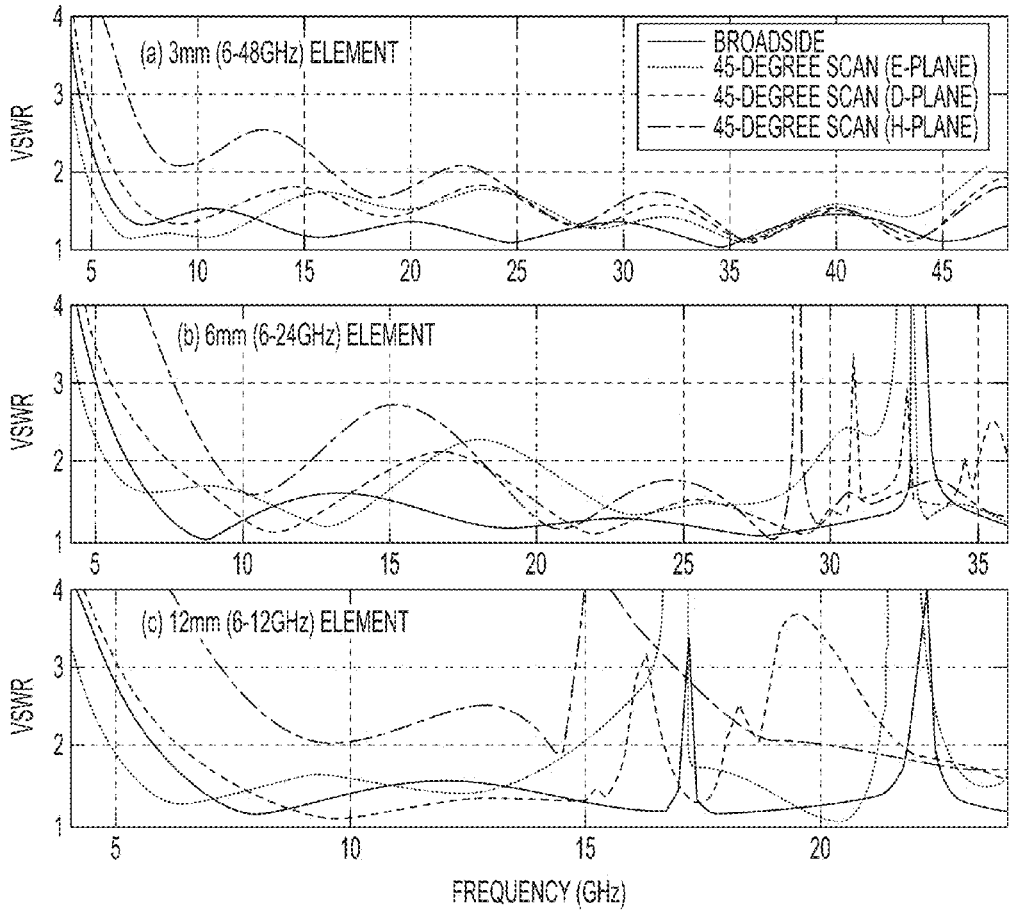
FIG. 5 is a graph of the simulated VSWR performance of the three elements of FIG. 4 (infinite cell), broadside, E-plane scan, D-plane scan, H-plane scan (to 45 degrees) according to the invention.

The VSWR performance for each of the elements using infinite Floquet cell analysis is given in FIG. 5. The plots show the broadside performance for each of the elements, plus scan performance at 45-degrees in the three most-common scan planes—E-plane (horizontal), D-plane (45-degree), and H-plane (vertical). At broadside all elements operate with VSWR below 2 within their specified frequency range, down to approximately 6 GHz. It is clear that scanning in the H-plane causes the worst degradation in VSWR (for all elements). However, FIG. 5 shows that for most of the operational frequency range, scanning can be achieved out to around 45 degrees with VSWR below 3, the lower end of the frequency spectrum suffering some degradation. In the following descriptions the performance of the integrated WSA is compared to these baseline element performance metrics.

The array configurations follow the basic layout of FIG. 3. The array is constructed from a 32×32 core of 3 mm elements, three 16×16 cores of 6 mm elements, and three 16×16 cores of 12 mm elements. The total element count for this array is 2.560 elements/polarization. In comparison, a traditional UWB array (of 3 mm elements) of the same aperture size would have a total of 16,384 elements/polarization. The WSA array analyzed here is a good compromise that allows proper evaluation of the WSA nuances without the data overload of larger array configurations or the dominance of truncation effects of smaller configurations.

Results

A. VSWR Performance

Figure 6:
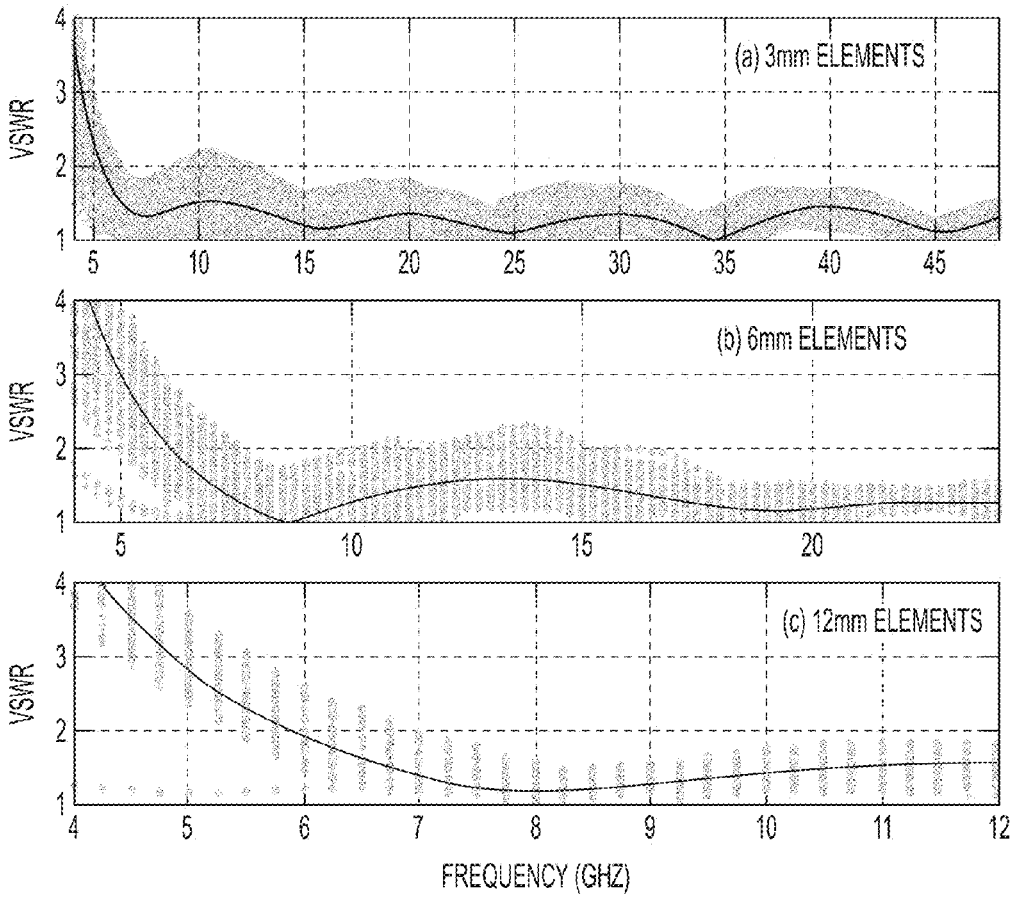
FIG. 6 is a graph of the VSWR sweep vs. frequency for broadside operation of the WSA (dark line—infinite cell, dots—finite array data) according to the invention.

We begin by evaluating the VSWR performance of the array at broadside operation, horizontal polarization. First, a sweep of VSWR vs. frequency of the WSA array is performed to compare with the infinite cell case. FIG. 6 shows the sweep of VSWR vs. frequency for each of the individual elements. In the plots, the dark curve is the ideal VSWR for an infinite array. This line is printed over a set of lighter dots representing the VSWR measured at each horizontal element of the array across the frequency band. These results show that the elements in the WSA follow the same basic performance curves as an ideal element, with deviation (plus and minus) on the order of roughly 0.5, slightly more at the low end, slightly less at the high end. In general, similar VSWR behavior is expected from any finite array. The most effective design practice is to minimize this effect by using the best-behaved elements possible, with the understanding that VSWR in finite arrays will not be as good as the infinite case. Here, we have demonstrated that reasonably good VSWR performance can be maintained for this WSA design. For the most part, VSWR has remained below 2 at broadside, with some cresting above at 13 GHz for the 3 mm and 6 mm elements. Further, it is important to point out that there is no evidence of the out-of-band lattice resonances of the 6 mm elements affecting the 3 mm elements (near 33 GHz), or the lattice resonances of the 12 mm element (near 17 GHz) affecting the operation of the 6 mm elements.

Figure 7:
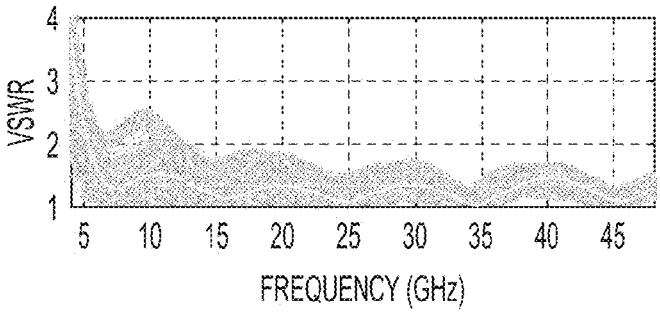
FIG. 7 is a graph of the VSWR sweep vs. frequency for a 32×32 finite array of 3 mm elements (dark line—infinite cell, dots—finite array data) according to the invention.

For comparison, the results for an equivalent finite array of 32×32 3 mm elements are presented in FIG. 7. Compared to the results in FIG. 6(*a*), the VSWR for the standalone finite array can be seen to be very similar to the WSA at higher frequencies, but markedly worse at low frequencies, where the VSWR crests about 0.3 higher around 10 GHz, to VSWR of 2.5. This gives some sense that the wavelength-scaled environment has a measurable and somewhat favorable effect on the array VSWR.

Figure 8:
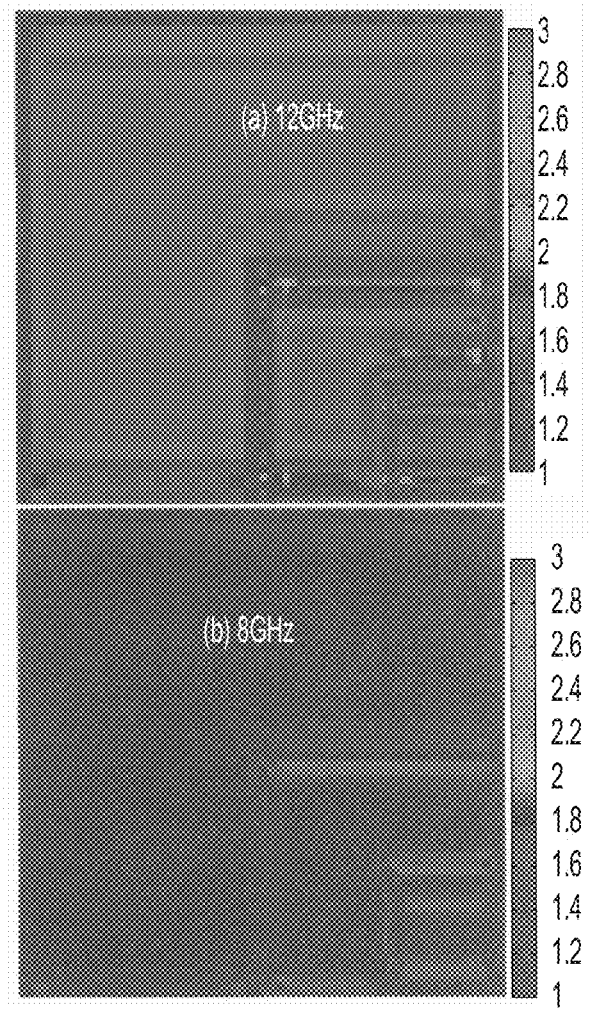
FIG. 8 is a plot of the spatial VSWR distribution on WSA at key frequencies for broadside radiation, horizontal polarization; each tile represents VSWR on horizontal element at that location (VSWR key beside plot) according to the invention.

While the curves of FIG. 6 give a good sense of the array performance as a whole across the frequency band, from the data spectrum it is not possible to glean the spatial effects of the wavelength-scaling on the VSWR. For this, we examine the VSWR distribution at specific frequencies. From FIG. 6 it is known that all element types experience a relative maximum in VSWR near 12 GHz, and a relative minimum near 8 GHz. Plots of the VSWR distribution for the WSA at these frequencies are given in FIG. 8, in which each different-shaded tile represents the port VSWR value of an active element at that spatial location, with the VSWR key printed beside the plot. Similar spatial effect on VSWR can be observed in both cases. What is important to take away from the data in FIG. 8 is that there is a noticeable ripple effect in the VSWR caused by the interfaces between element regions. Nevertheless, performance of the array in general remains within the range of requirements.

Figure 9:
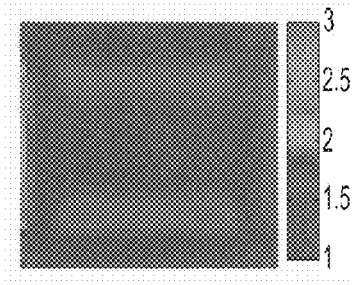
FIG. 9 is a plot of the spatial VSWR distribution on a 32×32 array of 3 mm elements at 8 GHz, broadside radiation, horizontal polarization (VSWR key beside plot) according to the invention.

For additional consideration, the VSWR distribution of a 32×32 array of 3 mm elements at 8 GHz is plotted in FIG. 9. When comparing the results of FIG. 6(*a*) to FIG. 7, it is clear that the standalone array of 3 mm elements has degraded VSWR at the low end of the frequency spectrum. FIG. 9 shows spatially where this increase of VSWR occurs—mainly across the left-most column of horizontal elements, where the element cores are closed along the edge by a column of vertical elements (see FIG. 2 or FIG. 3 for detail). We can conclude that the asymmetry of the VSWR distribution of FIG. 9 is attributable to the asymmetric construction of the array (because of the element pairs).

Next, the scanned VSWR performance of the WSA is examined for the case of E-plane and H-plane scanning. Based on the results from FIG. 5, it is clear that this class of element has better scanning performance in the E-plane and considerably worse VSWR vs. scanning in the H-plane. For VSWR, the D-plane scan falls in the middle of these two cases. Though the D-plane scan data has been collected and analyzed, for brevity we will not present it here. However, because of the geometrical asymmetry introduced by the wavelength-scaling and the layout of the element pairs, there is the potential for asymmetric scan performance as well.

Figure 10:
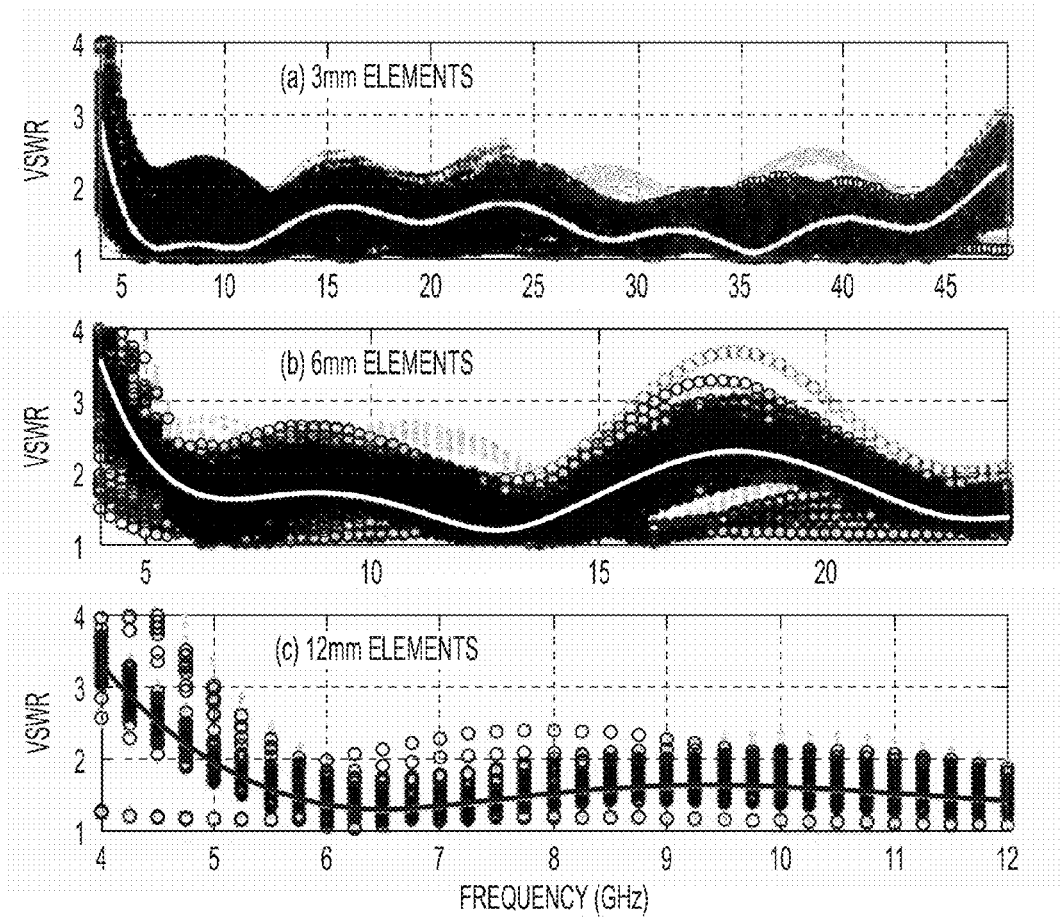
FIG. 10 is a graph of the VSWR sweep vs. frequency for E-plane scan; infinite cell (dark line), positive 45 degrees (dots), and negative 45 degrees (circles); individual dots represent spread of finite array data according to the invention.
Figure 11:
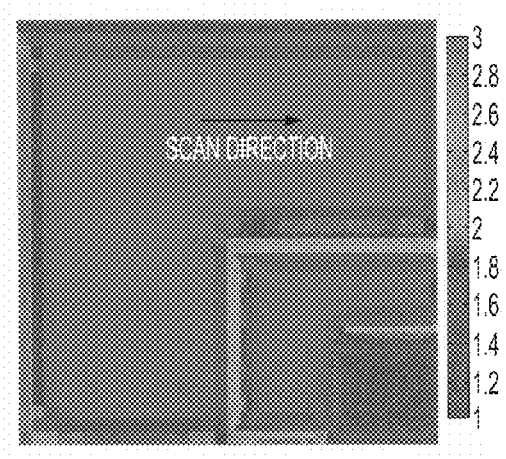
FIG. 11 is a plot of the spatial VSWR distribution for E-plane scan to positive 45 degrees at 10 GHz; each tile represents VSWR on horizontal element at that location (VSWR key beside plot) according to the invention.

Therefore, plots of both the positive 45-degree scan results (dots), and the negative 45-degree scan (circles) are provided for the case of E-plane scanning in FIG. 10, where the VSWR vs. frequency is plotted at a 45-degree scan. As for the broadside case, the response from the finite array follows the same general trend as the ideal element, with the VSWR swinging above and below the ideal case. There are two main items to point out here. First, under scan, the VSWR remains largely below 3 across the frequency band, as desired. This is important, as it indicates that this WSA architecture functions suitably well in a phased array application. Secondly, there appears to be groups of elements that stray from the rest, most notable at certain frequencies. For example, at 10 GHz, for each element type there is a group of elements with VSWR that is somewhat worse than the rest, most clearly visible in the group of 6 mm elements scanned to positive 45 degrees. From FIG. 11 it is clear that for this scan direction, these elements are typically the ones along the left edge of the cores, where the smaller elements transition into regions of larger elements.

Figure 12:
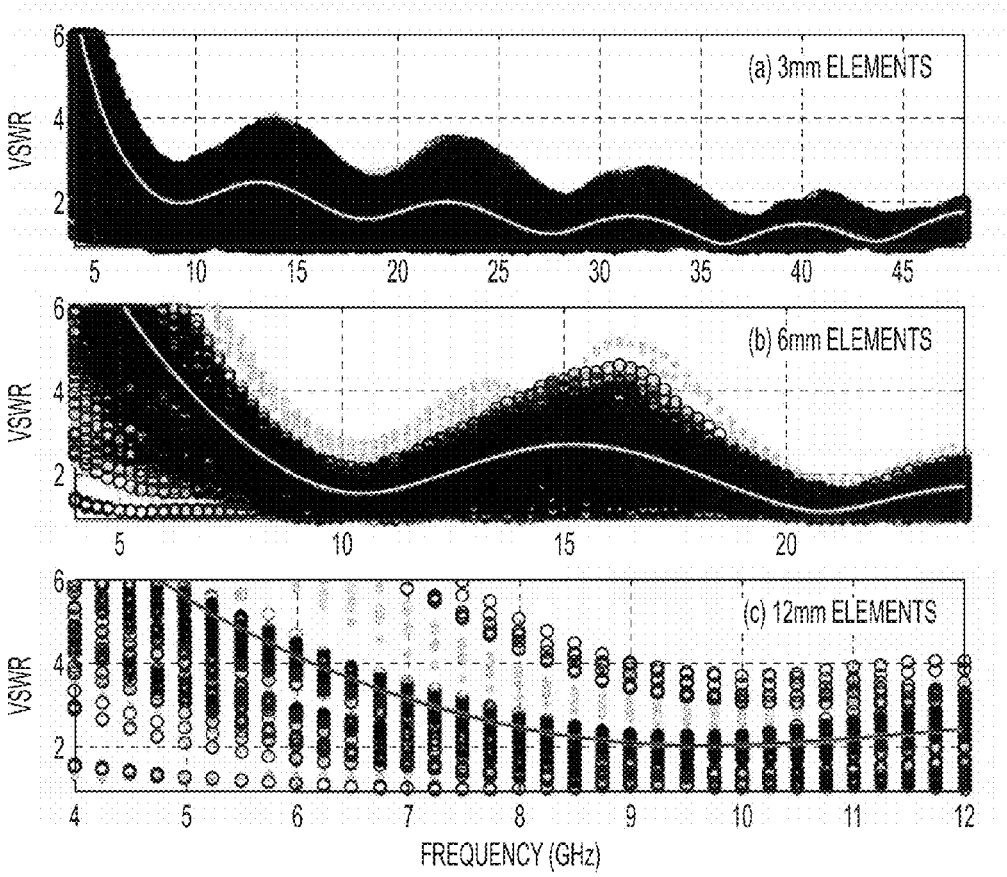
FIG. 12 is a graph of the VSWR sweep vs. frequency for H-plane scan at positive 45 degrees (dots) and negative 45 degrees (circles), dark line—infinite cell according to the invention.
Figure 13:
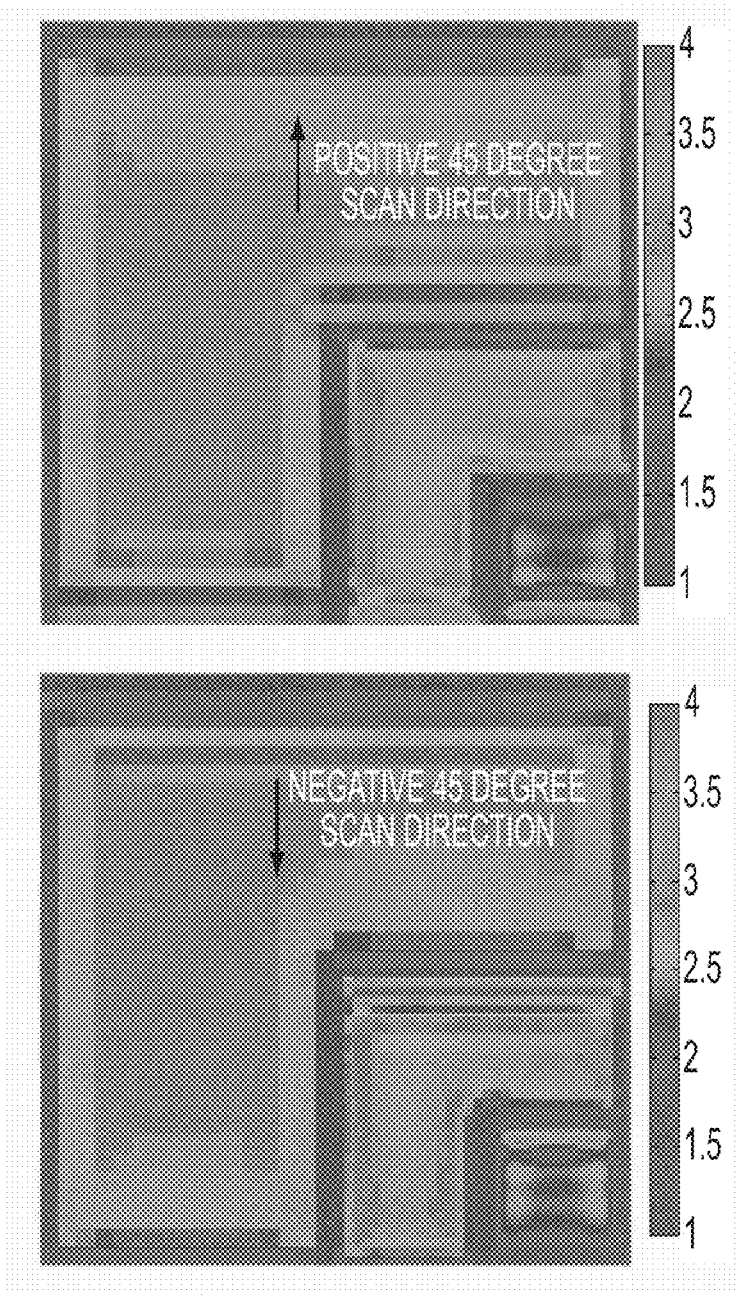
FIG. 13 is a plot of the VSWR distribution across array for 45-degree H-plane scan at 8 GHz; each tile represents VSWR on horizontal element at that location (VSWR key beside plot) according to the invention.

Next, the case of H-plane scanning at 45 degrees is considered. From the ideal results in FIG. 5 and from past experience, it is expected that VSWR is typically worst for scanning in the H-plane, with a noticeable loss of performance at the low-end of the frequency range. FIG. 12 shows the VSWR vs. frequency for the 45-degree H-plane scan. As before, the VSWR of the WSA largely follows the curves for the ideal infinite cell case. For the 3 mm element, though the VSWR does crest higher than desired at the lower frequencies, the elements are reasonably well-behaved as a whole. For the 6 mm and 12 mm elements, the majority of the elements follow the ideal curves, with the exception of certain groups of elements that appear to give somewhat worse behavior than the rest. To isolate these anomalies, FIG. 13 depicts the VSWR distribution for the array scanned to 45-degrees in the H-plane at 8 GHz. In the case of the positive 45-degree scan, while most of the array has similar VSWR behavior as the infinite array case, it is clear that much of the VSWR characteristic has changed with the change in scan angle. In this case, the worst VSWR occurs in rows of elements at transition regions opposite to the direction of scan. In the negative scan case, while the problem does not appear to occur right at the element transitions, it occurs in rows one element away from the transition, again, opposite to the direction of scan. The reason for the difference in the VSWR distribution on positive and negative scans can be partially attributed to the non-symmetric arrangement of the elements. Unfortunately, while the majority of the array shows good VSWR behavior when scanning to positive and negative 45-degrees. H-plane scanning is certainly a limiting factor, and careful consideration of H-plane scanning requirements need to be observed.

B. Array Mismatch Efficiency

Figure 14:
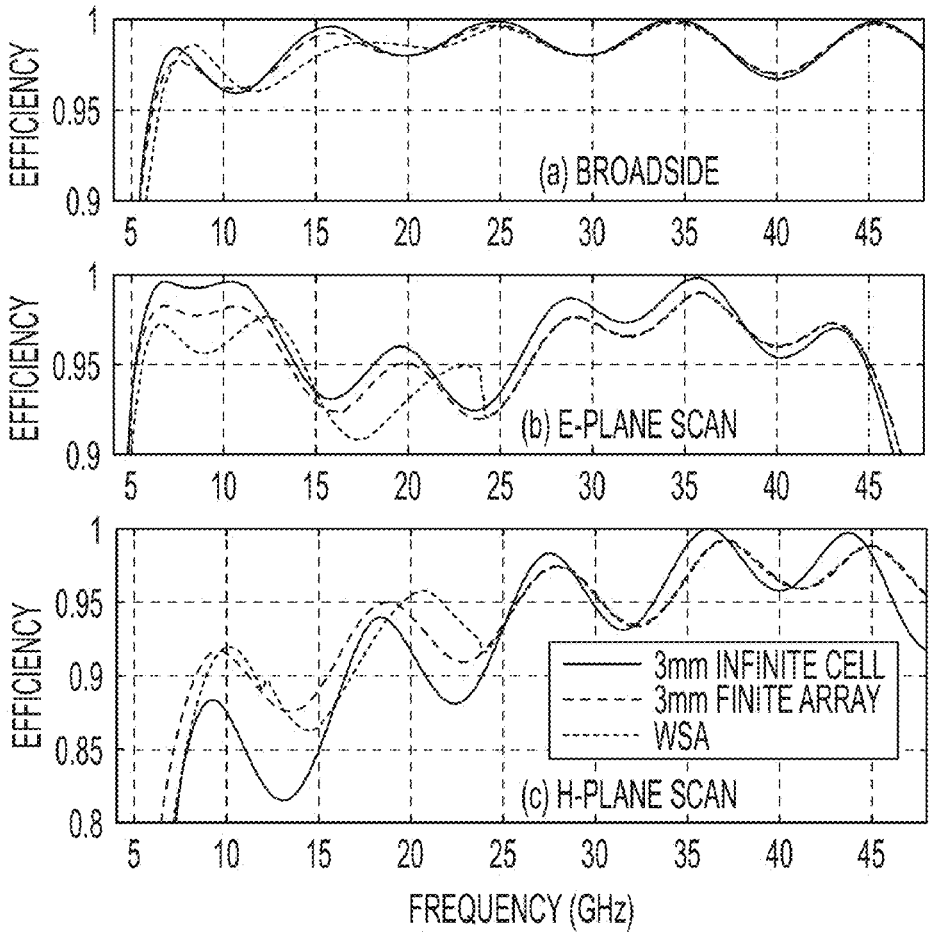
FIG. 14 is a graph of the array mismatch efficiency (vs. frequency) for three array cases; (a) broadside scan, (b) E-plane scan to 45 degrees, (c) H-plane scan to 45 degrees according to the invention.

The previous description on VSWR gives a sense of what is happening in specific regions of the WSA, down to the element level, and the invention preferably also includes the following aspects for performance enhancement. For finite array analysis it is also important to include array mismatch efficiency (average of the mismatch seen at the antenna ports) as a measure of overall array performance. This gives a single-valued figure-of-merit to gauge how well an array performs, on average, compared to the ideal (infinite) case. FIG. 14 compares the efficiency of the WSA array to an equivalent size conventional UWB array of 3 mm elements, and also the 3 mm element infinite (ideal) case. For the broadside case, FIG. 14(*a*) shows that the 3 mm finite array performs very close to ideal across the frequency band, and that the WSA—though it shows a slightly different function vs. frequency—is always within a few percent of ideal. The E-plane scan results indicate that WSA efficiency is as much as 3% worse than the 3 mm UWB at some frequencies, but also better at others. In the H-plane, as a consequence of effects in the finite array environment, both the 3 mm UWB array and the WSA show better efficiency at low frequencies—on average—than the infinite cell. Again, the WSA efficiency is always within a few percent of the conventional UWB array. This single figure-of-merit demonstrates that the WSA performs well (at the system level) across a wide bandwidth. As was the case in the VSWR study, the D-plane efficiency is somewhere between the E-plane and H-plane results. It should be pointed out that the jumps in efficiency seen for the WSA at 12 GHz and 24 GHz are a consequence of 12 mm elements turning off above 12 GHz and 6 mm elements turning off above 24 GHz.

C. Radiation Characteristics of the WSA

Figure 15:
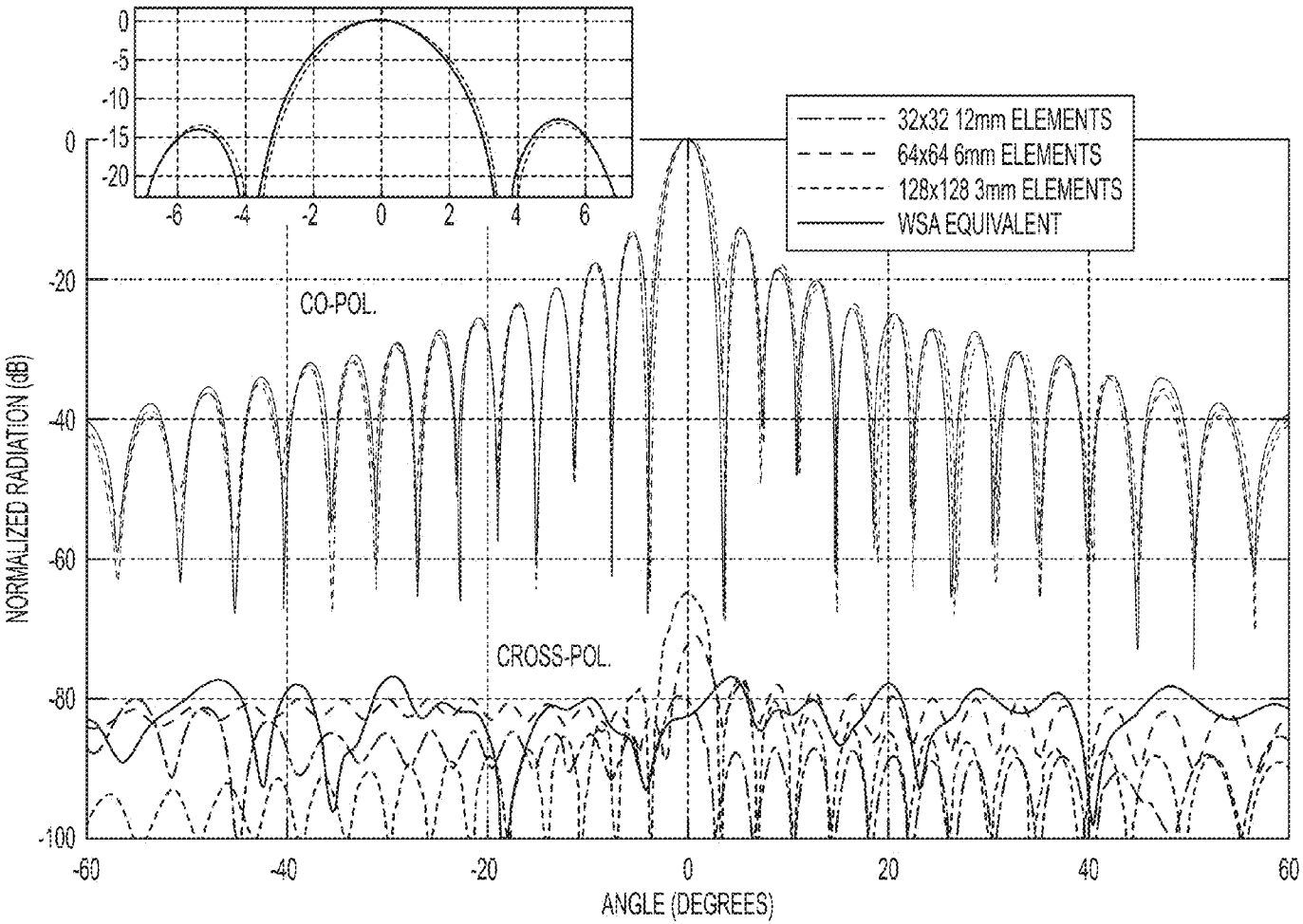
FIG. 15 is a graph of the far-field radiation patterns (E-plane cut) at 12 GHz; comparisons for the WSA and equivalent-sized arrays of single elements according to the invention.

Next, the far-field radiation characteristics of the WSA are considered. A comparison of the broadside far-field radiation pattern (E-plane cut) at 12 GHz of the WSA to like-sized arrays of 3 mm, 6 mm, and 12 mm elements is shown in FIG. 15. All patterns have nearly identical beam structure and similar cross-polarization levels. The upper left of the figure includes a zoomed-in view of the main lobe and first sidelobes, revealing a slight shift in the beam and imbalance in the sidelobe levels for the WSA. However, the difference is very minor and easily correctable using amplitude/phase correction.

Figure 16:
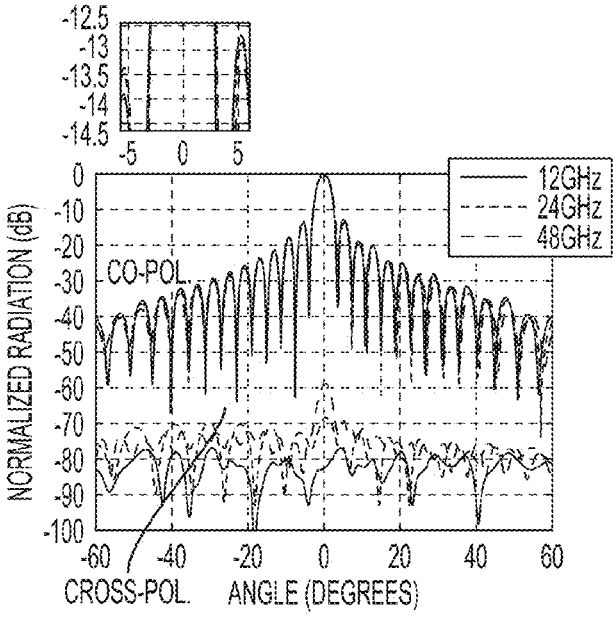
FIG. 16 is a graph comparing the far-field radiation patterns of the WSA at the three frequency points (12 GHz, 24 GHz, 48 GHz) to demonstrate relatively-constant beamwidth vs. frequency according to the invention.

The WSA operates with relatively constant beamwidth. FIG. 16 shows the beam structure of the WSA at three key frequencies across the 6-48 GHz range. At 12 GHz all the elements are active. At 24 GHz the 12 mm elements are not active, and at 48 GHz only the smallest elements are active. As can be seen, the beamwidth at these key frequencies is the same, and the lobe characteristics are quite similar as well. Further from the main beam the lobe structure shows some differences in radiation level, but for the most part, the patterns are remarkably similar. At 48 GHz the first sidelobes are symmetric at 13.35 dB down. At 24 GHz, the right sidelobe is approximately 0.7 dB higher than the left, and at 12 GHz the right sidelobe is about 1.2 dB higher than the left. The cross-polarization levels are typical of the underlying element properties—cross-polarization is typically worse at the higher frequencies, it is important to note that the wavelength-scaling does not appear to have a negative effect on the polarization purity.

D. Cross-Polarization (XPOL) Performance

The following presents the XPOL isolation figures for the WSA. XPOL is defined herein as the vertically-polarized field levels measured at a given scan angle relative to the horizontally-polarized field levels for an array of horizontally-polarized array elements. Table I shows the XPOL levels at three key frequencies (12 GHz, 24 GHz, and 48 GHz) for a 32×32 finite array of 3 mm elements. The table is interpreted as follows: at 12 GHz, when the array is scanned to theta/phi=−45/0, the co-polarized (COPOL) field levels are 40.3 dB higher than the XPOL fields. The results show that the 3 mm element has very good polarization purity in the principal planes—better than 40 dB for all scan angles. However, in the D-plane, the XPOL degrades. For scans to 45-degrees, at 12 GHz, there is 11 dB of XPOL rejection. At 24 GHz, there is 4.5 dB of XPOL rejection, and at 48 GHz, the XPOL levels are 3 dB higher than the COPOL fields. It has been observed for these longer elements that there is a null in the D-plane of the element pattern that pulls in for higher frequencies. This is a consequence of the element design—large bandwidth (8:1) comes at the cost of losing some polarization purity. Table II gives the XPOL numbers for the WSA. At 48 GHz (where only 3 mm elements are active), the numbers are very much the same as for the 3 mm element array. At 12 GHz and 24 GHz, the XPOL numbers for the WSA are slightly better. Table III shows the XPOL numbers for 32×32 arrays of 6 mm and 12 mm elements at 12 GHz. While polarization purity in the principle planes is on par, it's clear that the reduced-bandwidth elements have better XPOL levels in the 45-degree plane. This contributes to the WSA showing better XPOL numbers at lower frequencies. Although only data is included for the two principle planes plus the D-plane, data was collected for scanning in 15-degree increments from zero to 90 degrees. It was noted that the D-plane shows the worst XPOL scan performance.

TABLE I

CROSS-POLARIZATION PERFORMANCE OF A 32 × 32 ARRAY OF 3 MM ELEMENTS

| | | phi (degrees) | | | | | | | | |
|---|---|---|---|---|---|---|---|---|---|---|
| | | 0 | | | 45 | | | 90 | | |
| | | freq. (GHz) | | | | | | | | |
| | | 12 | 24 | 48 | 12 | 24 | 48 | 12 | 24 | 48 |
| theta (degrees) | −45 | −40.3 | −43.7 | −51.6 | −10.6 | −4.5 | 2.9 | −57.2 | −55.8 | −52.0 |
| | −30 | −44.7 | −47.2 | −61.5 | −17.2 | −11.6 | −5.7 | −57.4 | −54.9 | −49.3 |
| | −15 | −52.0 | −52.1 | −60.8 | −28.8 | −23.6 | −17.6 | −60.8 | −58.7 | −52.4 |
| | 0 | −63.4 | −60.8 | −59.9 | −63.4 | −60.8 | −59.9 | −63.4 | −60.8 | −59.9 |
| | 15 | −49.3 | −52.4 | −59.4 | −29.2 | −23.5 | −17.7 | −59.6 | −58.7 | −50.5 |
| | 30 | −43.8 | −46.5 | −55.2 | −17.4 | −11.5 | −5.7 | −57.2 | −56.3 | −48.2 |
| | 45 | −39.4 | −43.3 | −49.5 | −10.7 | −4.4 | 2.8 | −57.1 | −55.8 | −50.6 |

TABLE II

CROSS-POLARIZATION PERFORMANCE OF THE WSA

| | | phi (degrees) | | | | | | | | |
|---|---|---|---|---|---|---|---|---|---|---|
| | | 0 | | | 45 | | | 90 | | |
| | | freq. (GHz) | | | | | | | | |
| | | 12 | 24 | 48 | 12 | 24 | 48 | 12 | 24 | 48 |
| theta (degrees) | −45 | −47.2 | −43.2 | −51.8 | −14.5 | −5.2 | 2.9 | −49.0 | −47.4 | −58.0 |
| | −30 | −50.9 | −47.7 | −58.5 | −21.0 | −11.9 | −5.6 | −50.3 | −48.5 | −53.6 |
| | −15 | −57.0 | −55.0 | −60.1 | −32.2 | −23.7 | −17.6 | −55.0 | −52.8 | −54.5 |
| | 0 | −82.9 | −70.4 | −59.2 | −82.9 | −70.4 | −59.2 | −82.9 | −70.4 | −59.2 |
| | 15 | −56.9 | −52.4 | −59.7 | −32.7 | −23.9 | −17.7 | −55.7 | −55.7 | −51.4 |
| | 30 | −50.7 | −46.9 | −55.4 | −21.3 | −12.0 | −5.7 | −50.4 | −49.5 | −51.2 |
| | 45 | −47.2 | −43.1 | −50.1 | −14.6 | −5.3 | 2.9 | −49.3 | −47.5 | −54.3 |

TABLE III

CROSS-POLARIZATION FOR 32 × 32 ARRAYS OF 6 MM AND 12 MM ELEMENTS (AT 12 GHz)

| | | element size | | | | | |
|---|---|---|---|---|---|---|---|
| | | 6 mm | 12 mm | 6 mm | 12 mm | 6 mm | 12 mm |
| | | phi (degrees) | | | | | |
| | | 0 | | 45 | | 90 | |
| theta (degrees) | −45 | −47.1 | −49.8 | −11.2 | −15.4 | −48.6 | −50.7 |
| | −30 | −50.9 | −53.4 | −18.2 | −22.1 | −50.0 | −52.1 |
| | −15 | −57.2 | −58.9 | −29.9 | −33.1 | −54.3 | −56.9 |
| | 0 | −70.9 | −80.1 | −70.9 | −80.1 | −70.9 | −80.1 |
| | 15 | −54.4 | −59.7 | −30.1 | −33.5 | −57.8 | −57.2 |
| | 30 | −49.5 | −53.4 | −18.3 | −22.2 | −51.4 | −52.4 |
| | 45 | −46.1 | −50.1 | −11.2 | −15.5 | −49.3 | −50.9 |

The cost-savings generated by the WSA architecture (i.e. 6.4-times reduction) is that achieved with an active electronics package behind each element of the array. However, there are options for combining active and passive electronics that produce additional cost savings. At the lower frequencies, the 3 mm-element core of the WSA is highly oversampled. In other words, to meet sampling requirements from 6-12 GHz for receive aperture applications, it is only necessary to collect signals from every fourth row, or equivalently, a single element in every 4×4 sub-array of elements. Similarly, sampling requirements can be satisfied by collecting signals from every-other row of 6 mm elements, or equivalently, one element in every 2×2 sub-array. However, this approach reduces gain. Further, for transmit applications, reduced sampling will not work because the passive elements in the radiating environment of the active elements receive and re-radiate energy out of phase with the original signal, causing significant performance degradation. Similarly, at the lower frequencies it would be possible to passively combine the 4×4 sub-arrays of 3 mm elements and 2×2 sub-arrays of 6 mm elements into a single port. This option works for transmit applications as well.

For the UWB described above, the elements are scaled in such a way that the low end frequency limit is similar for all elements. Further, the smallest elements of the array operate across the full frequency band. This is not necessarily the only choice for scaling, nor is it necessary to implement a design for which certain elements operate at all frequencies. The elements may alternatively be scaled such that they share a common range of bandwidth, yet have larger (outer) elements extend to a lower frequency range that does not overlap with the rest of the array elements. Hence, some amount of overlap can be introduced if this meets the objective of achieving the lowest element count.

Figure 19:
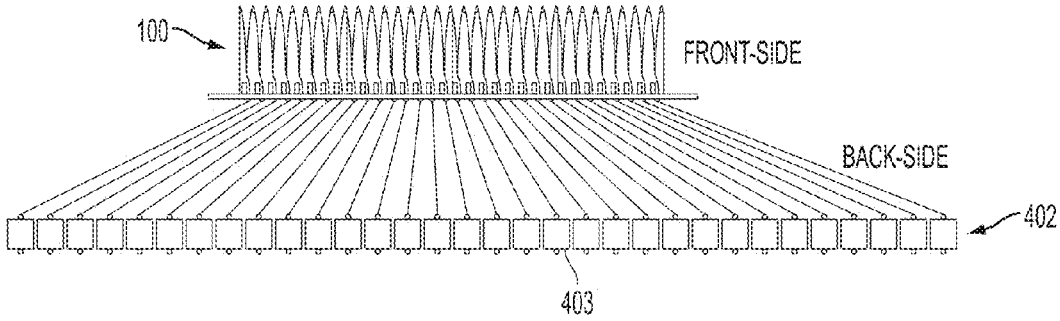
FIG. 19 PRIOR ART
FIG. 19 is a representative feed network for prior art UWB arrays with active electronic packages.
Figure 20:
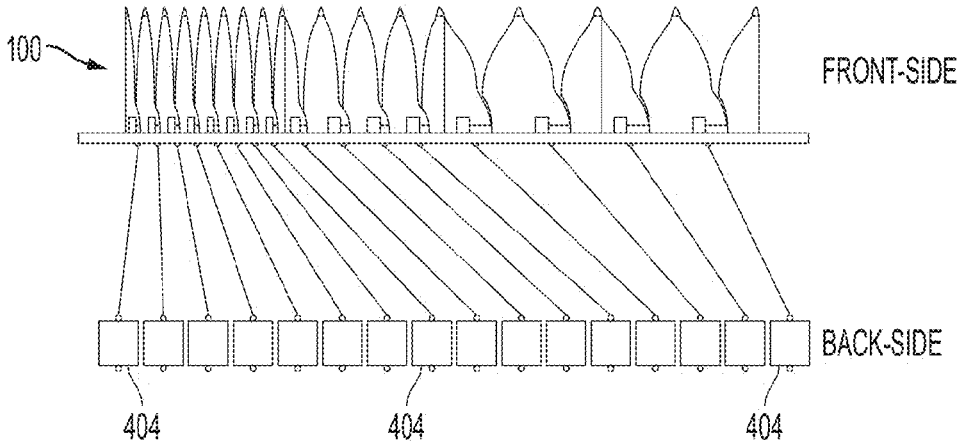
FIG. 20 is an embodiment of the WSA with an active electronic feed system according to the invention.
Figure 21:
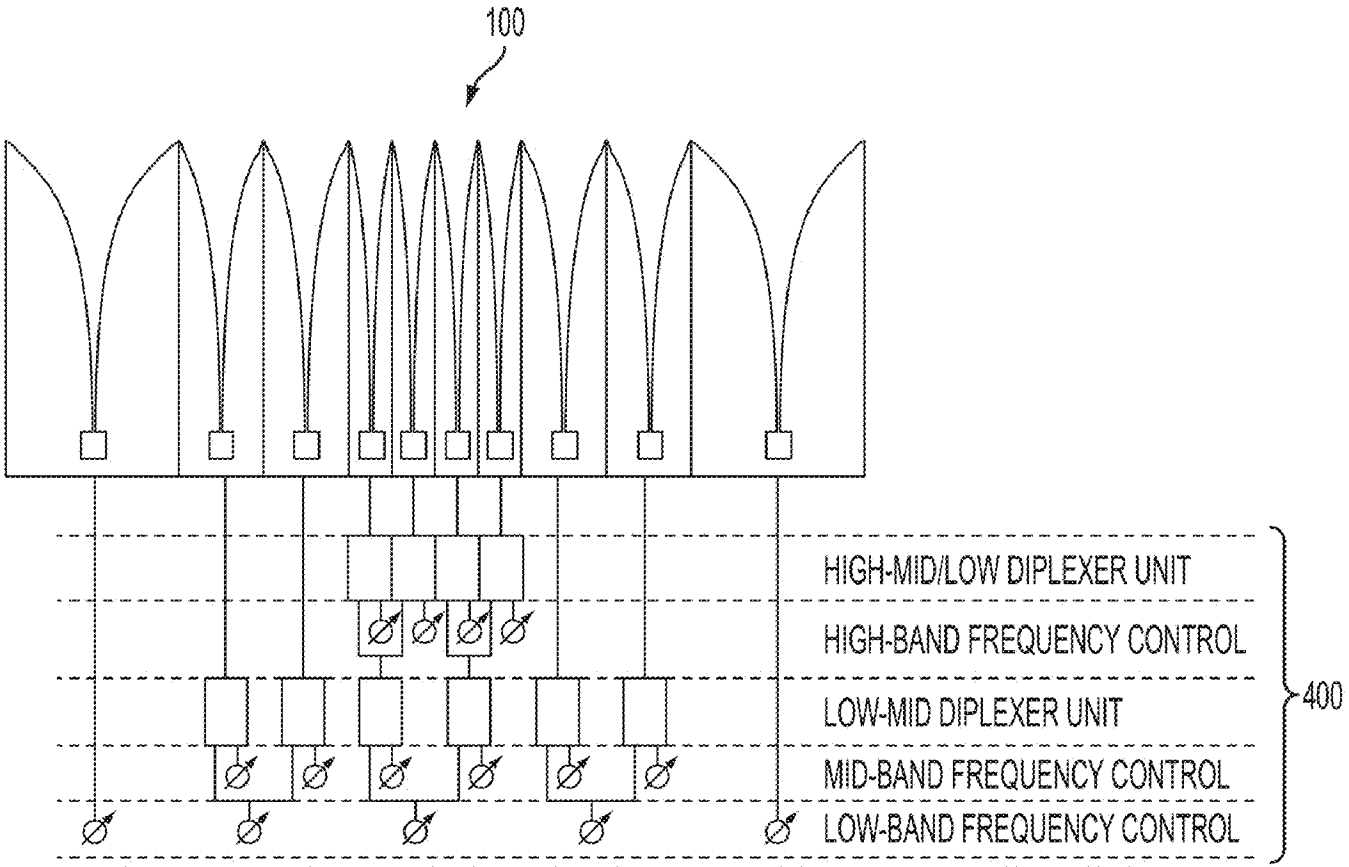
FIG. 21 is an embodiment of the WSA with a combined passive and active electronic feed system according to the invention.
Figure 22:
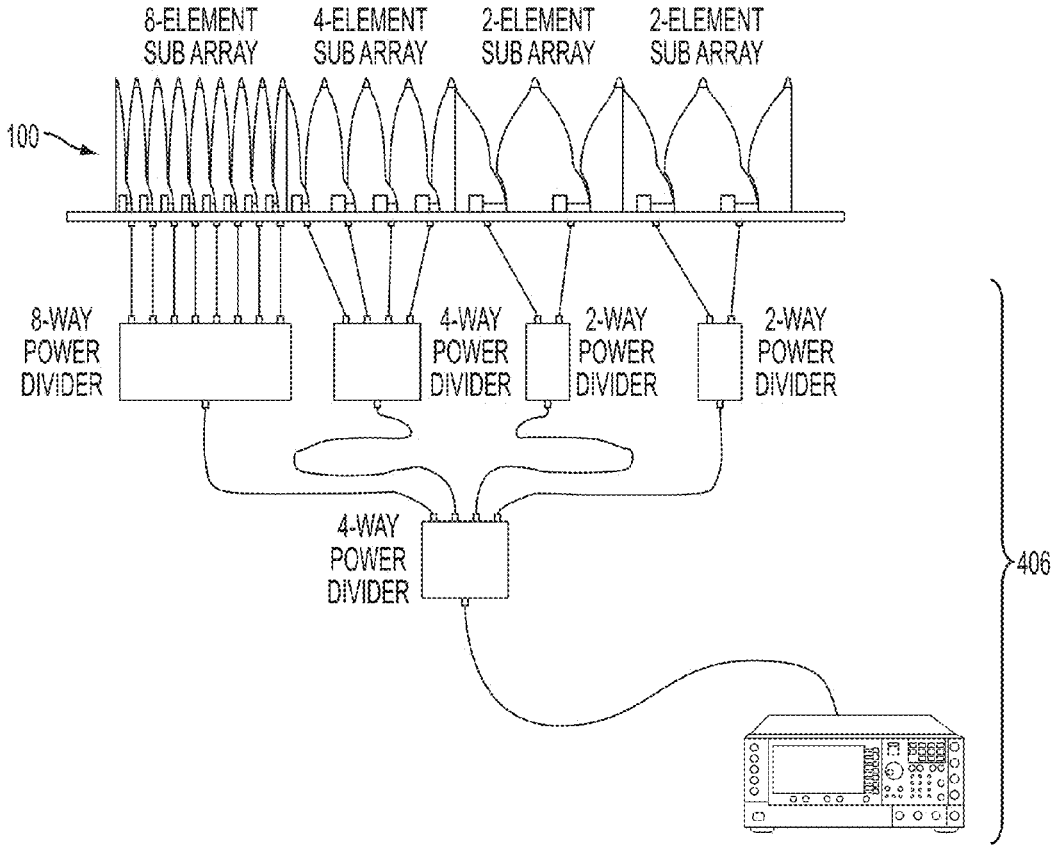
FIG. 22 is an embodiment of the WSA with a passive electronic feed system according to the invention.

FIG. 19 shows a conventional 32×32 UWB array with electronic feed 402 packages behind each element. If the electronic packages 403 are larger than elements it causes dilation, the back-side electronics taking up more space than the front end. FIG. 20 shows the equivalent WSA 100 with the same active electronic packages 404 behind each element—fewer elements means the electronics will not dilate past the array front-side dimensions. This is an important advantage of the WSA architecture. FIG. 21 shows an embodiment of the WSA 100 with a combination 400 of passive and active electronics. Here, each element fed via a passive diplexer unit. The diplexer splits the signals into two bands. The higher of the two bands feeds into the signal source/phase control unit. The lower band either feeds into another diplexer unit, or at the lower frequency, feeds into a power splitter/combiner or directly into signal source/phase control. The diagram includes but does not show a power combiner/splitter. The most challenging component is the diplexer unit behind the smallest, high-frequency elements, which must split the signal into a high channel, and a low-mid channel. It is likely this unit will be wider than the elements. However, as explained in the previous paragraph, because of the scaled architecture, it is possible to dilate the electronics but not exceed the overall footprint of the array. Because of the dilation involved, calibration techniques would be required to synchronize the array signals. FIG. 22 shows the WSA 100 with a fully passive feeding option 406 using power combiners/dividers. The same scaling principles are applied to the power dividers as to the aperture elements. The feeding system shown automatically adjusts the power levels reaching each element in the WSA to generate a uniform radiating phase front, but may require some phase/amplitude adjustment to account for differences in the power divider units.

Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. An ultra-wideband antenna array architecture, comprising:

a first array of radiating elements, wherein each first array radiating element has a first width;

a second array of radiating elements, wherein each second array radiating element has a second width greater than said first width; and a third array of radiating elements, wherein each third array radiating element has a third width greater than said second width; and wherein said first, second, and third arrays are positioned in a wavelength-scaled lattice and have an ultra-wideband antenna configuration such that said first, second, and third arrays when powered up operate together as an integrated aperture that generates a substantially grating lobe-free beam over a continuous ultra-wideband range of frequencies; and wherein each said width is the lattice spacing of adjacent elements in each said array; and a feed means for feeding power to each array.

2. The array of claim 1, wherein each radiating element of said first, second and third arrays is an offset-center pair of wideband elements on a rectangular lattice.

3. The array of claim 2, wherein each radiating element of said first, second and third arrays includes excitations scaled based on cell size and every other row of radiating elements are interaligned.

4. The array of claim 2, wherein each radiating element of said first, second and third arrays has an electronic feed synchronized to produce an ultra-wideband array signal.

5. The array of claim 4, wherein the first array electronic feed is a first diplexer with a high-band frequency control, the second array electronic feed is a second diplexer with a mid-band frequency control, and the third array electronic feed is a low-band frequency control.

6. The array of claim 1, wherein the first width is half a wavelength at the highest frequency of operation, the second width is twice the first width, and the third width is twice the second width.

7. The array of claim 1, wherein each radiating element of said first, second and third arrays is electrically coupled to each adjacent element.

8. The array of claim 1, wherein the first array is positioned in a corner of the lattice, the second array is adjacent the first array, and the third array is adjacent the second array.

9. The array of claim 1, wherein the first array is positioned in a center of the lattice, the second array forms a first perimeter around the first array, and the third array forms a second perimeter around the second array.

10. The array of claim 9, wherein the lattice has a diamond or triangular shape and all the radiating elements of said first, second and third arrays are co-incident phase pairs.

11. An ultra-wideband antenna array, comprising:

a first array of radiating elements, wherein each first array radiating element has a first width;

a second array of radiating elements, wherein each second array radiating element has a second width greater than said first width; and a third array of radiating elements, wherein each third array radiating element has a third width greater than said second width; and wherein said first, second, and third arrays are positioned in a wavelength-scaled lattice and have an ultra-wideband antenna configuration such that said first, second, and third arrays when powered up operate together as an integrated aperture that generates a substantially grating lobe-free beam over a continuous ultra-wideband range of frequencies; and wherein each said width is the lattice spacing of adjacent elements in each said array; and an individual electronic feed electrically connected to each radiating element of said first, second and third arrays.

12. The array of claim 11, wherein the first width is half a wavelength at the highest frequency of operation, the second width is twice the first width, and the third width is twice the second width.

13. The array of claim 11, wherein each radiating element of said first, second and third arrays is electrically coupled to each adjacent element.

14. The array of claim 11, wherein the first array is positioned in a corner of the lattice, the second array is adjacent the first array, and the third array is adjacent the second array.

15. The array of claim 11, wherein the first array is positioned in a center of the lattice, the second array forms a first perimeter around the first array, and the third array forms a second perimeter around the second array.

16. The array of claim 15, wherein the lattice has a diamond or triangular shape and all the radiating elements of said first, second and third arrays are co-incident phase pairs.

17. An ultra-wideband antenna array, comprising:

a first array of radiating elements, wherein each first array radiating element has a first width;

a second array of radiating elements, wherein each second array radiating element has a second width greater than said first width; and a third array of radiating elements, wherein each third array radiating element has a third width greater than said second width; and wherein said first, second, and third arrays are positioned in a wavelength-scaled lattice and have an ultra-wideband antenna configuration such that said first, second, and third arrays when powered up operate together as an integrated aperture that generates a substantially grating lobe-free beam over a continuous ultra-wideband range of frequencies; and wherein each said width is the lattice spacing of adjacent elements in each said array; and a passive diplexer feed means for feeding each radiating element of said first, second and third arrays at a selected frequency.

18. The array of claim 17, wherein the first width is half a wavelength at the highest frequency of operation, the second width is twice the first width, and the third width is twice the second width.

19. The array of claim 17, wherein each radiating element of said first, second and third arrays is electrically coupled to each adjacent element.

20. The array of claim 17, wherein the first array is positioned in a corner of the lattice, the second array is adjacent the first array, and the third array is adjacent the second array.

21. The array of claim 17, wherein the first array is positioned in a center of the lattice, the second array forms a first perimeter around the first array, and the third array forms a second perimeter around the second array.

22. The array of claim 21, wherein the lattice has a diamond or triangular shape and all the radiating elements of said first, second and third arrays are co-incident phase pairs.

* * * * *